US010024091B2

(12) United States Patent
Shaharbany

(10) Patent No.: US 10,024,091 B2
(45) Date of Patent: Jul. 17, 2018

(54) DOOR CLOSER ASSEMBLY WITH HOLLOW HINGE MEMBER

(71) Applicant: Ronen Shaharbany, Kfar Sava (IL)

(72) Inventor: Ronen Shaharbany, Kfar Sava (IL)

(73) Assignee: MATECHET KFAR-SABA SHAHARBANI BROS. (1980) LTD., Kfar-Saba East Industrial Area (IL)

( * ) Notice: Subject to any disclaimer, the term of this patent is extended or adjusted under 35 U.S.C. 154(b) by 290 days.

(21) Appl. No.: 14/930,880

(22) Filed: Nov. 3, 2015

(65) Prior Publication Data

US 2017/0122017 A1 May 4, 2017

(51) Int. Cl.

| | |
|---|---|
| ***E05D 11/08*** | (2006.01) |
| ***E05F 5/02*** | (2006.01) |
| ***E05F 3/16*** | (2006.01) |
| ***E05F 3/20*** | (2006.01) |

(52) U.S. Cl.

CPC ..... *E05D 11/082* (2013.01); *E05F 3/16* (2013.01); *E05F 3/20* (2013.01); *E05F 5/02* (2013.01); *E05D 2011/085* (2013.01)

(58) Field of Classification Search

CPC ..... E05D 7/086; E05D 11/081; E05D 11/082; E05D 11/087; E05D 2011/085; E05F 3/00; E05F 3/12; E05F 3/16; E05F 3/20; E05F 5/02

USPC ..... 16/49, 50

See application file for complete search history.

(56) References Cited

U.S. PATENT DOCUMENTS

| | | | | | |
|---|---|---|---|---|---|
| 365,413 | A * | 6/1887 | Stuart | B62C 5/00 | 16/342 |
| 1,823,202 | A * | 9/1931 | Kern | B60J 1/04 | 16/341 |
| 2,493,116 | A * | 1/1950 | Diebel | E05F 3/20 | 16/273 |
| 2,646,589 | A * | 7/1953 | Quinn | E05F 3/02 | 16/66 |
| 4,190,925 | A * | 3/1980 | Koivusalo | E05F 3/20 | 16/312 |
| 4,358,870 | A * | 11/1982 | Hong | E05F 3/20 | 16/53 |
| 5,507,070 | A * | 4/1996 | Spyche, Jr. | A61G 17/02 | 16/49 |
| 5,572,768 | A * | 11/1996 | Daul | E05F 1/1215 | 16/337 |
| 5,651,536 | A * | 7/1997 | Daul | E05F 1/1215 | 16/50 |
| 8,024,841 | B2 * | 9/2011 | Shen | G06F 1/1681 | 16/339 |

* cited by examiner

*Primary Examiner* — Roberta S Delisle

(74) *Attorney, Agent, or Firm* — Dekel Patent Ltd; David Klein

(57) ABSTRACT

A door closer assembly includes a central shaft rotatingly mounted in an outer housing and which passes through at least one brake pad. One or more wedges are slidingly mounted on the central shaft by means of a fastener. The wedges, upon tightening of the fastener, wedge against an inclined surface, which forces the wedges downwards and applies a downwards force that causes a friction-enhanced surface to rub against the at least one brake pad.

4 Claims, 6 Drawing Sheets

DOOR CLOSER ASSEMBLY WITH HOLLOW HINGE MEMBER

FIELD OF THE INVENTION

The present invention relates generally to door closer assemblies, and more specifically to a door closer assembly that prevents slamming of the door.

BACKGROUND OF THE INVENTION

Door closures are known which include a cylinder and piston with a fluid such as air or oil and wherein during door opening or closing, the piston compresses the fluid so as to prevent a door from slamming. Such door closures are difficult to adjust in that the leakage of the fluid must be adjusted so as to control the speed of operation of the door closing mechanism.

SUMMARY OF THE INVENTION

The present invention seeks to provide a door closer assembly that prevents slamming of the door, as is described more in detail hereinbelow.

The door closer assembly of the present invention has an adjustable brake that safely brakes closing of the door to prevent slamming. The door closer of the invention, when installed in the hinge side of a door, provides a highly safe door for installation in schools, hospitals, hotels, office buildings and many others. The door closer assembly can be installed in any kind of door, wood or metal, for example. The door closing is quiet and no annoying sounds of door slamming will be heard in the building.

There is provided in accordance with an embodiment of the invention a door closer assembly including a central shaft rotatingly mounted in an outer housing and passing through at least one brake pad, and one or more wedges slidingly mounted on the central shaft by means of a fastener, wherein the wedges, upon tightening of the fastener, wedge against an inclined surface, which forces the wedges downwards and applies a downwards force that causes a friction-enhanced surface to rub against the at least one brake pad.

A ratchet wheel may be rotatingly mounted on the central shaft and the outer housing may include a ratchet pawl operative to ratchet with ratchet teeth of the ratchet wheel. There may be a pair of brake pads, one pad below the ratchet wheel and the other pad above the ratchet wheel. The one or more wedges may bear down on a washer and a spacer element may be placed on the at least one brake pad.

There is provided in accordance with an embodiment of the invention a door assembly including a door installed in a frame, the door arranged to swing on a hinge including a hinge rod that passes through a hollow hinge member attached to a hinge side of the door, the hollow hinge member extending substantially a full height of the door and wherein a radius of the hollow hinge member is sufficiently large such that there is substantially no gap between a door post of the frame and the door on the hinge side, and a door closer assembly assembled inside the hollow hinge member operative to control closure of the door to prevent slamming of the door. Flanges may extend from the hollow hinge member and may be affixed to the door.

The door closer assembly may include a central shaft rotatingly mounted in an outer housing and which passes through at least one brake pad. One or more wedges may be slidingly mounted on the central shaft by means of a fastener, wherein the wedges, upon tightening of the fastener, wedge against an inclined surface, which forces the wedges downwards and applies a downwards force that causes a friction-enhanced surface to rub against the at least one brake pad.

The door closer assembly may include a motorized damping system or a viscous damping system.

BRIEF DESCRIPTION OF THE DRAWINGS

The present invention will be understood and appreciated more fully from the following detailed description taken in conjunction with the drawings in which.

DETAILED DESCRIPTION OF EMBODIMENTS

Figure 1:
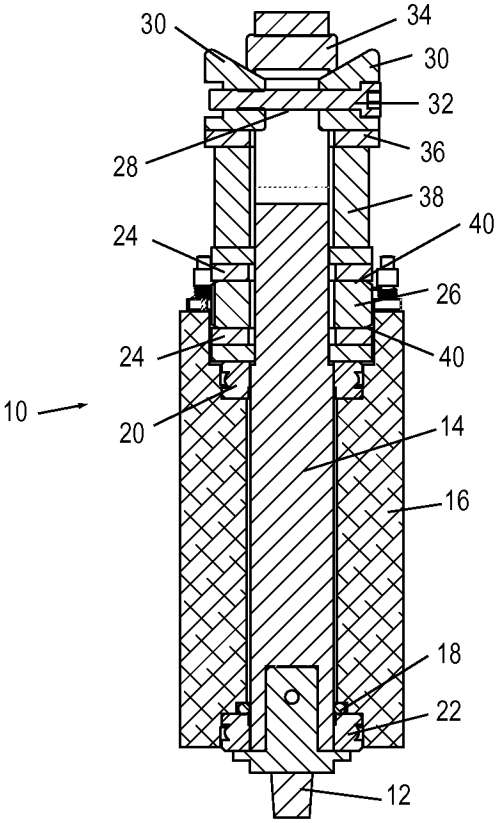
FIGS. 1, 2 and 3 are simplified sectional and two different exploded illustrations, respectively, of a door closer assembly, constructed and operative in accordance with an embodiment of the present invention.
Figure 2:
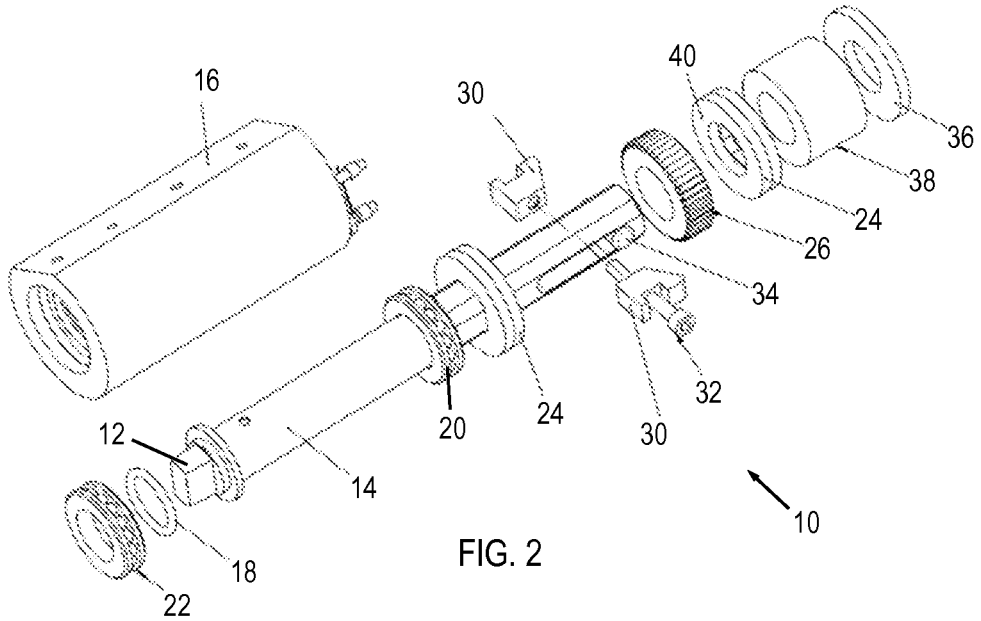
Figure 3:
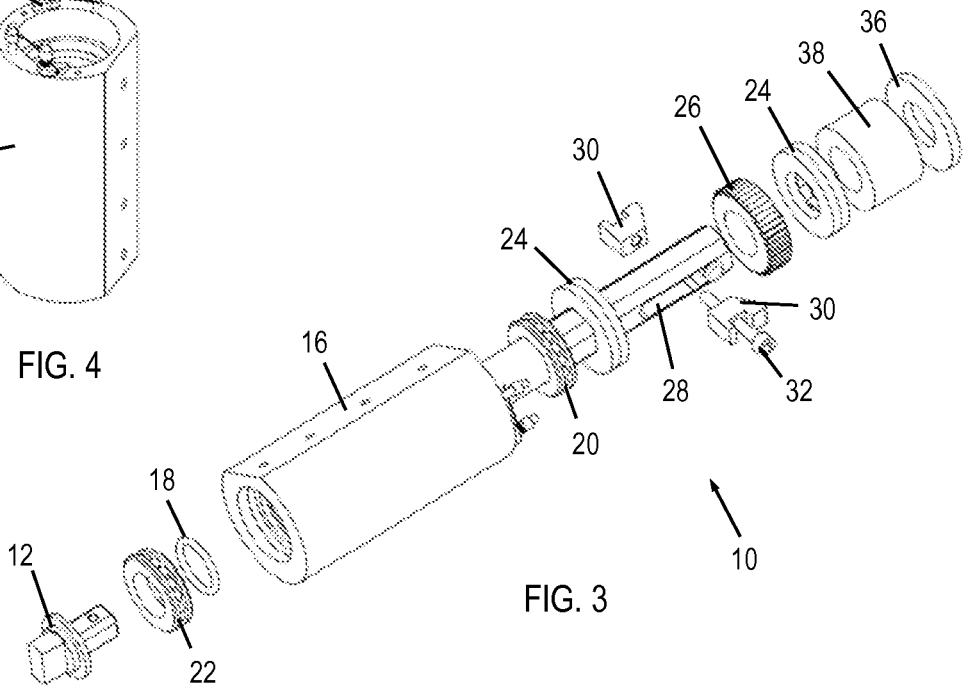

Reference is now made to FIGS. 1, 2 and 3, which illustrate a door closer assembly 10, constructed and operative in accordance with a non-limiting embodiment of the present invention.

The door closer assembly 10 includes a lower bushing 12 for mounting in a hinge side of a door (as seen later in FIG. 5). The lower bushing 12 fits into a recess at the bottom end of a central shaft 14. The central shaft 14 is rotatingly mounted in an outer housing 16 and journaled by upper and lower bearings 20 and 22, respectively. An O-ring 18 may seal the shaft 14 above the lower bearing 22.

Central shaft 14 passes through at least one brake pad 24 and through a ratchet wheel 26. In the illustrated embodiment, there is a pair of brake pads 24, one pad placed below the ratchet wheel 26 and the other pad placed above wheel 26. The upper portion of central shaft 14 is formed with a channel 28. One or more wedges 30 (two are provided in the illustrated embodiment) are slidingly mounted on central shaft 14 by means of a fastener 32 (such as a screw) that passes through channel 28. The wedges 30, upon tightening of fastener 32, wedge against an inclined surface 34, such as a chamfered rod, which forces the wedges 30 downwards and thus applies a downwards force against the brake pads 24. Wedges 30 may bear directly against the brake pad 24 (the upper pad if there is more than one pad), or instead, as in the illustrated embodiment, the wedges 30 bear down on a washer 36 and spacer element 38, which are placed on the upper brake pad 24. The spacer element 38 may be made of a flexible material, such as polyurethane or an elastomer.

The ratchet wheel 26 may be formed with a friction-enhanced surface 40, such as an abrasive surface, that rubs against the brake pad 24 during braking. In the illustrated embodiment, ratchet wheel 26 is formed with upper and lower friction-enhanced surfaces 40 that rub against the upper and lower brake pads 24, respectively. Alternatively, the friction-enhanced surface 40 may be formed on the bottom of the wedges 30 to rub directly against the brake pad 24, if no washer 36 and spacer element 38 are used. As another alternative, washer 36 or spacer element 38 may be provided with the friction-enhanced surface 40 to rub against the brake pad 24.

Figure 4:
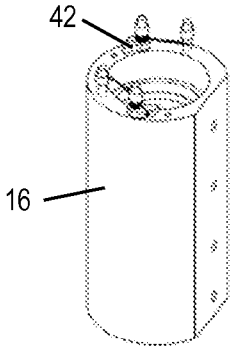
FIG. 4 is a simplified pictorial illustration of housing of the door closer, with a ratchet pawl.

Reference is now made to FIG. 4, which illustrates outer housing 16 with a ratchet pawl 42. Pawl 42 ratchets with the ratchet teeth of ratchet wheel 26, so as to permit rotation in one direction only. Pawl 42 may be adjusted so as to permit either clockwise or counterclockwise movement of the assembly 10, depending on the installation in the door (e.g., left-handed or right-handed door).

Figure 5:
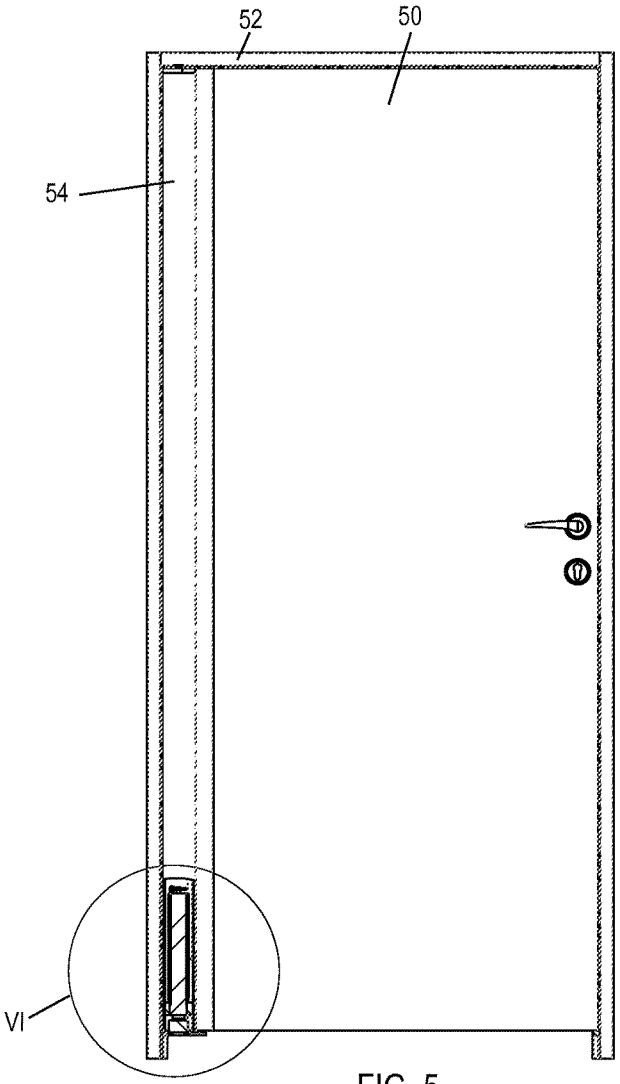
FIG. 5 is a simplified pictorial illustration of the door closer assembly installed in a hinge side of a door, in accordance with an embodiment of the present invention.
Figure 6:
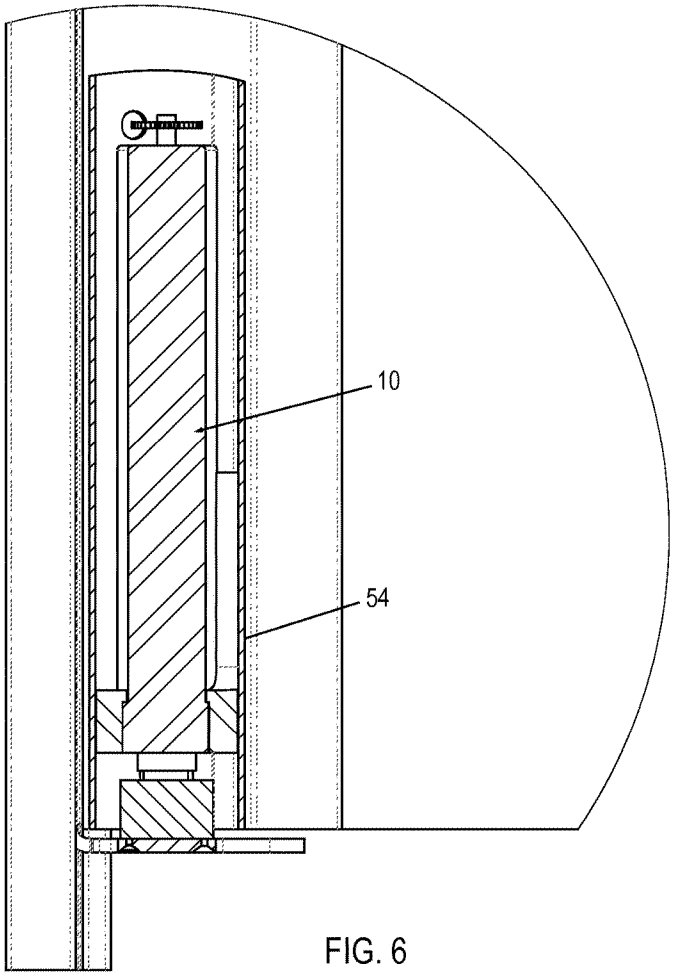
FIG. 6 is an enlarged portion of the door assembly of FIG. 5, showing the door closer assembly installed in place.
Figure 7:
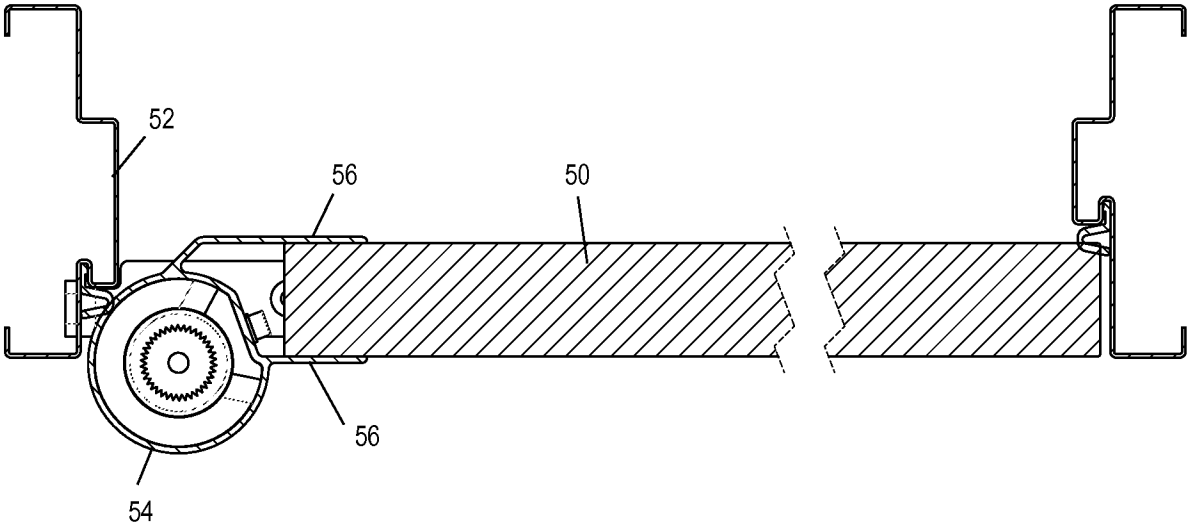
FIG. 7 is a top view illustration of the door closer assembly installed in the door.

Reference is now made to FIGS. 5-7, which illustrate the door closer assembly 10 installed in a hinge side of a door 50, in accordance with an embodiment of the present invention. Door 50 may be made of any suitable material, such as metal or wood, and may be provided with a handle, a lock and rosette. Door 50 is installed in a frame 52, and swings on a hinge constructed of a hinge rod that passes through a hollow hinge member 54 attached to the hinge side of door 50. The hollow hinge member 54 extends substantially the full height of door 50.

As seen in FIG. 7, the radius of the hollow hinge member 54 is sufficiently large such that there is substantially no gap between the door post of frame 52 and door 50 on the hinge side, which helps prevent any finger jamming there. Flanges 56 extend from hollow hinge member 54 that are affixed to door 50.

As seen in FIG. 6, the door closer assembly 10 is installed inside and near the bottom of the hollow hinge member 54. If someone wishes to slam door 50 closed, the brake pads brake the swinging motion (rotational velocity) of the door, thereby slowing the closure of the door and preventing slamming. The braking force of the wedges can be adjusted by tightening or loosening the fastener, which increases or decreases the downward force on the brake pads.

Figure 9:
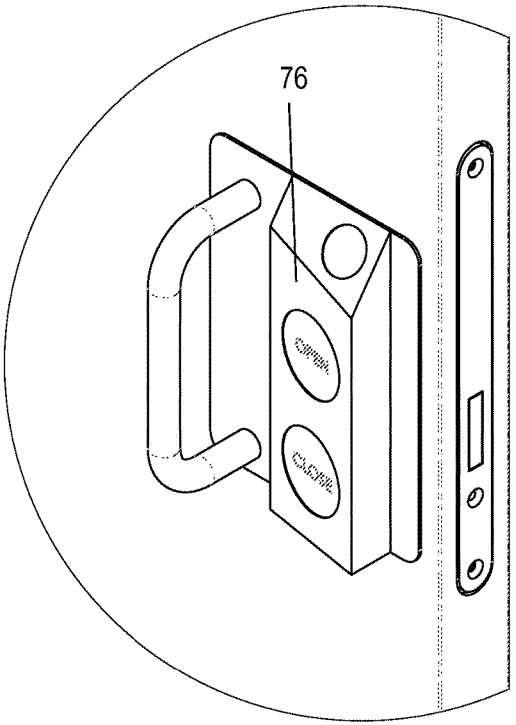
FIG. 9 is a simplified enlarged illustration of a control panel for opening or closing the door of FIG. 8.
Figure 8:
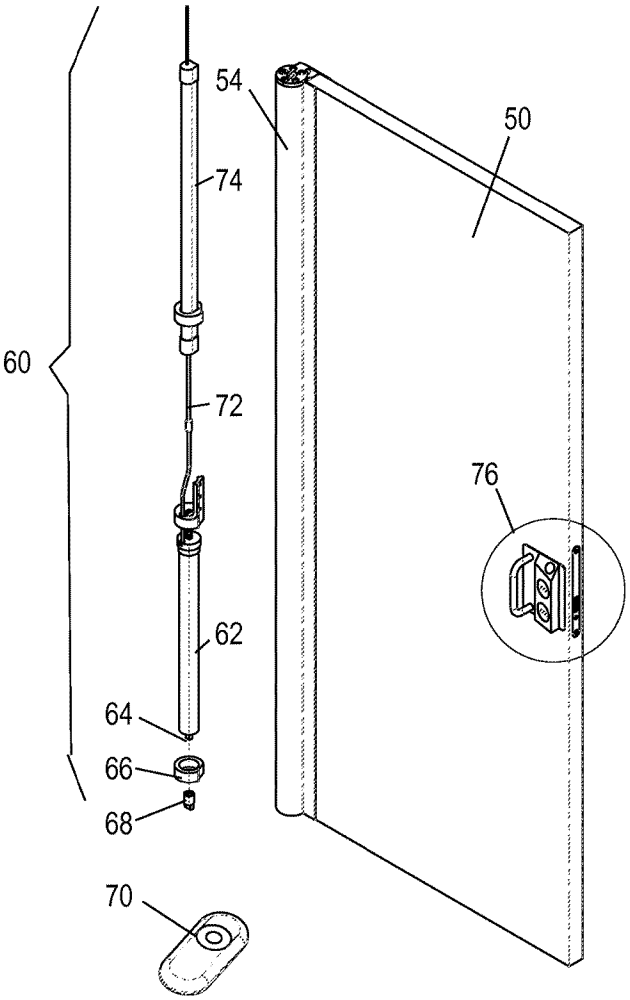
FIG. 8 is a simplified pictorial illustration of a door closer assembly for installation in a door, in accordance with another embodiment of the present invention, including a motorized damping system installed in a hollow hinge member of the door.

Reference is now made to FIG. 8, which illustrates a door closer assembly 60 for installation in door 50, in accordance with another embodiment of the present invention. The door closer assembly 60 is a motorized damping system installed in the hollow hinge member 54 of door 50. The motorized damping system 60 includes a motor 62 with a rotatable axle 64. Axle 64 is mounted through a support cup 66 and bushing 68 and rotatingly supported below by a bearing 70. Axle is connected on the top side via a connecting rod 72 to a turning arm 74 which is rotatingly connected to the door. Rotation of motor 62 rotates axle 64, which in turns rotates turning arm 74 to rotate door 50. The motor 62 controls the rotation of door 50 thereby slowing the closure of the door and preventing slamming. The motor 62 may be operated by a control panel 76 (FIG. 9), which may have separate open and close touch button switches, or other kinds of switches. Additionally or alternatively, motor 62 may be operated by remote control. The system is user-friendly even for handicapped or elderly persons with limited capability of opening doors.

Figure 10:
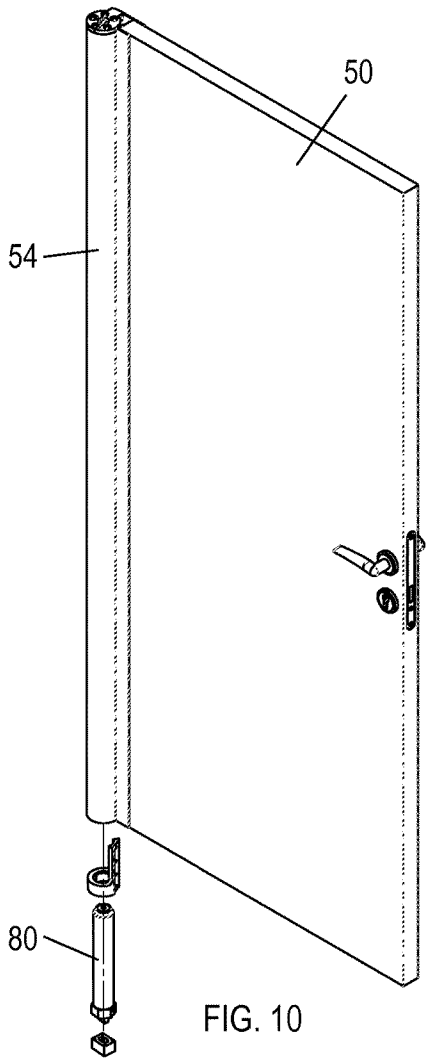
FIG. 10 is a simplified pictorial illustration of a door closer assembly for installation in a door, in accordance with yet another embodiment of the present invention, including a viscous damping system installed in a hollow hinge member of the door.

Reference is now made to FIG. 10, which illustrates a door closer assembly 80 for installation in door 50, in accordance with yet another embodiment of the present invention. The door closer assembly 80 includes a viscous damping system installed in hollow hinge member 54 of door 50. The viscous damping system may include a viscous fluid, such as oil, that dampens the closure of the door and prevents slamming.

What is claimed is:

1. A door closer assembly comprising:

a central shaft rotatingly mounted in an outer housing and passing through at least one brake pad; and one or more wedges slidingly mounted on said central shaft by means of a fastener, wherein said wedges, upon tightening of said fastener, wedge against an inclined surface, which forces said wedges downwards and applies a downwards force that causes a friction-enhanced surface to rub against said at least one brake pad, and wherein a ratchet wheel is rotatingly mounted on said central shaft and said outer housing comprises a ratchet pawl operative to ratchet with ratchet teeth of said ratchet wheel.

2. The door closer assembly according to claim 1, wherein said at least one brake pad comprises a pair of brake pads, one pad below said ratchet wheel and the other pad above said ratchet wheel.

3. The door closer assembly according to claim 1, wherein said friction-enhanced surface is formed on said ratchet wheel.

4. A door closer assembly comprising:

a central shaft rotatingly mounted in an outer housing and passing through at least one brake pad; and one or more wedges slidingly mounted on said central shaft by means of a fastener, wherein said wedges, upon tightening of said fastener, wedge against an inclined surface, which forces said wedges downwards and applies a downwards force that causes a friction-enhanced surface to rub against said at least one brake pad, wherein said one or more wedges bear down on a washer and a spacer element placed on said at least one brake pad.

* * * * *